US006729925B2

(12) United States Patent
Meguro et al.

(10) Patent No.: US 6,729,925 B2
(45) Date of Patent: May 4, 2004

(54) METHOD FOR MANUFACTURING DISCHARGE TUBE AND DISCHARGE LAMP

(75) Inventors: Takeshi Meguro, Ibaraki (JP); Kazuhiko Senoo, Hirakata (JP); Motomi Sakoda, Takatsuki (JP); Hitoshi Asayama, Suita (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 161 days.

(21) Appl. No.: 10/028,203

(22) Filed: Dec. 20, 2001

(65) Prior Publication Data

US 2002/0098767 A1 Jul. 25, 2002

(30) Foreign Application Priority Data

Jan. 24, 2001 (JP) ..... 2001-015403

(51) Int. Cl.[7] ..... H01J 9/26
(52) U.S. Cl. ..... 445/26; 445/43; 313/623
(58) Field of Search ..... 445/26, 43, 22, 445/77, 44, 25, 40, 27; 313/623, 636

(56) References Cited

U.S. PATENT DOCUMENTS

| | | | | |
|---|---|---|---|---|
| 5,108,333 A | | 4/1992 | Heider et al. | |
| 5,286,227 A | * | 2/1994 | Numajiri et al. | 445/26 |
| 5,411,565 A | * | 5/1995 | Cognolato et al. | 65/386 |
| 5,984,749 A | * | 11/1999 | Nishibori et al. | 445/26 |
| 5,986,403 A | | 11/1999 | Jansen et al. | |
| 6,071,164 A | * | 6/2000 | Vollmer | 445/26 |
| 6,132,279 A | * | 10/2000 | Horiuchi et al. | 445/26 |
| 6,285,130 B1 | * | 9/2001 | Nakagawa et al. | 445/26 |
| 6,368,175 B1 | * | 4/2002 | Horiuchi et al. | 445/26 |
| 6,487,878 B1 | * | 12/2002 | Meguro et al. | 65/34 |
| 6,517,404 B1 | * | 2/2003 | Lamouri et al. | 445/26 |

FOREIGN PATENT DOCUMENTS

| | | |
|---|---|---|
| EP | 866 488 A | 9/1998 |
| EP | 944 109 A | 9/1999 |
| EP | 1 024 515 | 8/2000 |
| JP | 57-109234 | 7/1982 |
| JP | 58-089756 A | 5/1983 |
| JP | 7-142034 | 6/1995 |
| JP | 2997464 | 10/1999 |

* cited by examiner

*Primary Examiner*—Dean A. Reichard
*Assistant Examiner*—Angel R. Estrada
(74) *Attorney, Agent, or Firm*—Merchant & Gould, P.C.

(57) ABSTRACT

In a method for manufacturing a discharge tube including a discharge part, a sealing part formed at an end of the discharge part, and an electrode provided in the discharge part, the method includes inserting an electrode body having the electrode into a portion to be the sealing part that is adjacent to a portion to be the discharge part of a transparent insulating tube serving as a material for the discharge tube, and then sealing the portion to be the sealing part by heating and softening with a combination of a laser beam and a gas burner, thus forming the sealing part. Heat sources are selected suitably according to each region in the portion to be the sealing part, whereby a high-quality discharge tube that is highly resistant to pressure can be manufactured at high production efficiency and low cost.

12 Claims, 7 Drawing Sheets

METHOD FOR MANUFACTURING DISCHARGE TUBE AND DISCHARGE LAMP

BACKGROUND OF THE INVENTION

1. Field of the Invention

The present invention relates to a method for manufacturing a discharge tube and a discharge lamp having the discharge tube.

2. Description of Related Art

A conventionally known discharge lamp, for example, a high-pressure mercury lamp, has a quartz discharge tube including a discharge part in which mercury and a rare gas are sealed, electrodes provided inside the discharge part and sealing parts formed at both ends of the discharge part.

In such a conventional high-pressure mercury lamp, in particular, the sealing parts of the discharge tube used therein can be formed by heating and softening portions to be the sealing parts of a straight quartz tube, which is a material for the discharge tube, and sealing them by pinching or shrinking.

A laser beam achieves a higher working accuracy than a commonly-used gas burner. Thus, it has been suggested that the laser beam be used as a heat source for heating and softening the quartz tube so that a high-quality discharge tube that is highly resistant to sealing pressure can be obtained (see JP 57(1982)-109234 A and JP 2997464 B).

However, such a conventional method for manufacturing the high-pressure mercury lamp using the laser beam has had the following problems. That is, especially when manufacturing a discharge tube with a long sealing part, since the laser beam can heat only a part of the quartz tube serving as a workpiece, it takes too long to heat and soften a long portion to be the sealing part of the quartz tube entirely, thus lowering a production efficiency. Also, since a high-power laser beam is needed to heat and soften the entire long portion to be the sealing part in a sufficient manner, the size of the device increases, resulting in higher cost.

SUMMARY OF THE INVENTION

It is an object of the present invention to solve the problems described above and to provide a low-cost method for manufacturing a discharge tube, by which a high-quality discharge tube that is highly resistant to pressure can be obtained and the production efficiency can be improved. It is a further object of the present invention to provide a discharge lamp including a low-cost discharge tube that is highly resistant to pressure.

A method for manufacturing a discharge tube of the present invention, the discharge tube including a discharge part, a sealing part formed at an end of the discharge part and an electrode provided in the discharge part, includes inserting an electrode body having the electrode into a portion to be the sealing part, which is adjacent to a portion to be the discharge part, of a transparent insulating tube serving as a material for the discharge tube, and sealing the portion to be the sealing part by heating and softening with a combination of a laser beam and a gas burner, thus forming the sealing part.

This makes it possible to select suitably the laser beam and the gas burner serving as heat sources for heating and softening the portion to be the sealing part according to each region in the portion to be the sealing part. In particular, by using the laser beam for a portion requiring a high working accuracy in the portion to be the sealing part, for example, the end of the portion to be the sealing part on the side of the portion to be the discharge part, it is possible to achieve an airtight sealing without any distortion, thereby obtaining a high-quality discharge tube that is highly resistant to pressure. Also, by using the gas burner having a larger heat capacity and a wider heating range than the laser beam for portions other than the above-noted portion requiring a high working accuracy, it is possible to seal a wide range of region in a short time, thus improving a production efficiency. In addition, by limiting the region to be heated and softened with the laser beam to the portion requiring a particularly high working accuracy, it becomes possible to use a laser beam having a lower output power. This allows a miniaturization of the device and a cost reduction.

Furthermore, a discharge lamp of the present invention includes a discharge tube obtained by the above-mentioned manufacturing method of the present invention. This makes it possible to provide a low-cost discharge lamp including a discharge tube that is highly resistant to pressure.

DESCRIPTION OF THE PREFERRED EMBODIMENTS

The following is a description of embodiments of the present invention, with reference to the accompanying drawings.

First Embodiment

Figure 5:
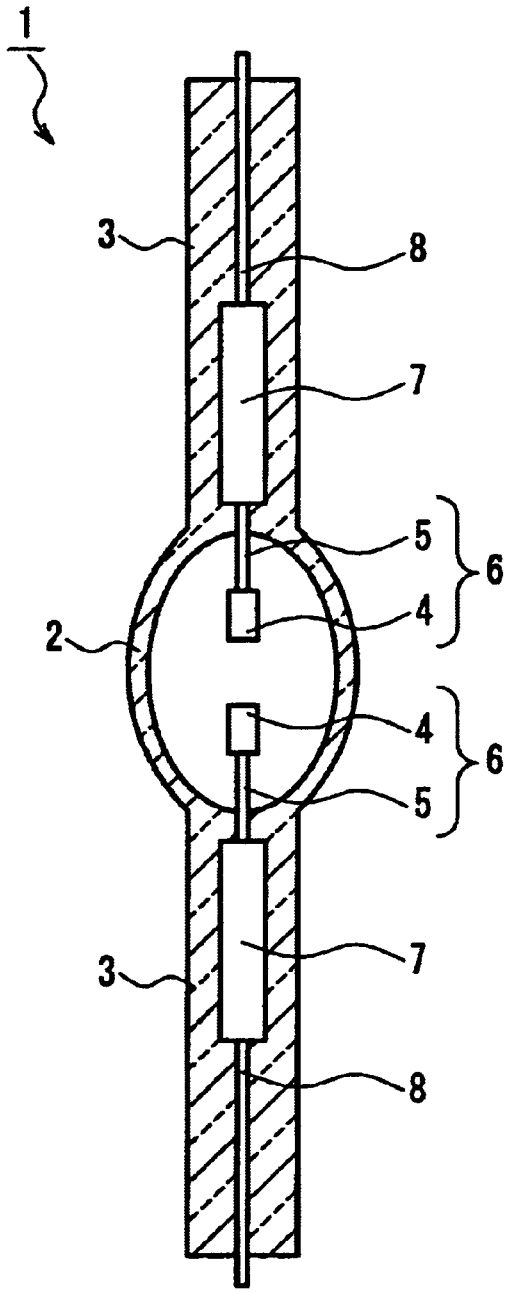
FIG. 5 is a front sectional view showing one embodiment of a discharge tube produced by the method for manufacturing the discharge tube according to the present invention.

As shown in FIG. 5, a quartz discharge tube 1 of a high-pressure mercury lamp, which is manufactured by a method for manufacturing a discharge tube according to an embodiment of the present invention, includes a spheroidal discharge part 2 generally having a length of about 10 mm and a maximum outer diameter of about 10 mm and cylindrical sealing parts 3 that are formed at both ends of the discharge part 2 and generally have a length of about 25 mm and an outer diameter of about 6 mm.

At both ends inside the discharge part 2, electrodes 6 are provided, each having an electrode lead rod 5. The electrodes may be of tungsten. The electrode lead rod 5 has an electrode coil 4 at its tip. Each of the electrodes 6 is connected to a lead wire 8 via a metal foil 7 such as molybdenum, which is sealed in each of the sealing parts 3.

In addition, a predetermined amount of mercury, metal halides and a noble gas is enclosed in the discharge part 2.

Next, a method for manufacturing the discharge tube 1 of the high-pressure mercury lamp will be described.

Figure 1:
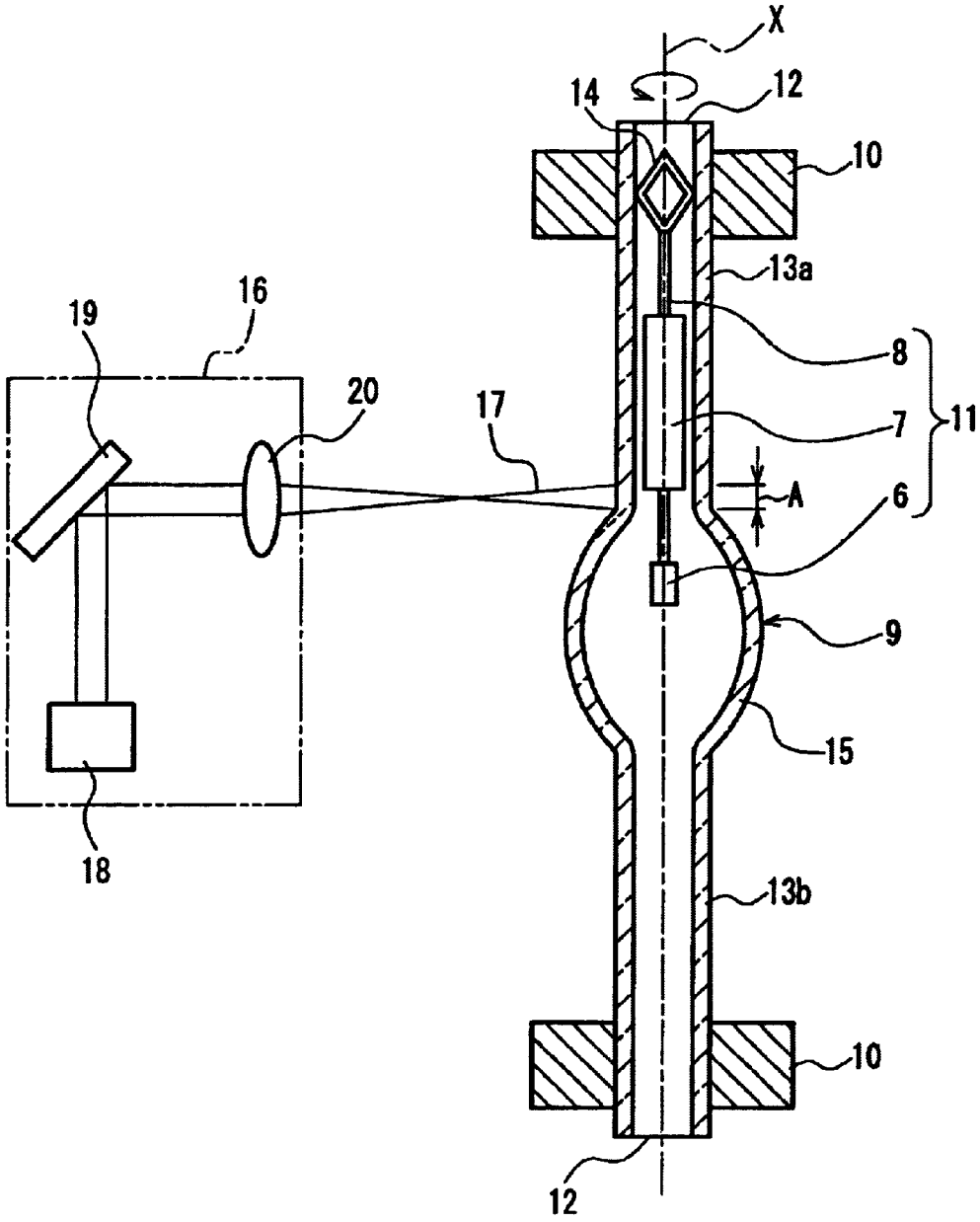
FIG. 1 is a sectional view for describing one process of an embodiment of a method for manufacturing a discharge tube according to the present invention.

A straight transparent insulating tube 9, for example made of quartz glass, as shown in FIG. 1 is used as a material for the discharge tube 1.

First, the transparent insulating tube 9 is provided with a portion 15 to be the discharge part 2, which will be described later. In the following, a process sequence thereof will be described.

Although not shown in the figure, a central portion of this transparent insulating tube 9 is heated and softened with a gas burner that may use oxygen and hydrogen for fuel. Thereafter, one opening 12 of the transparent insulating tube 9 is closed temporarily, and an inert gas is blown from the other opening 12 into the transparent insulating tube 9, thereby inflating the softened portion of the transparent insulating tube 9 with pressure of the inert gas. Further, a mold is pressed against the inflated portion of the transparent insulating tube 9, thereby forming this portion into a spheroidal shape. In this manner, the portion 15 can be formed.

Next, portions of the transparent insulating tube 9 that are adjacent to the portion 15 and in an internal communication therewith, namely, portions 13*a* and 13*b* to be the sealing parts 3 described below, are sealed, so as to form the sealing parts 3. In the following, a process sequence thereof will be described.

As shown in FIG. 1, with the transparent insulating tube 9 being kept upright, both ends thereof are clamped with chucks 10, whereby the transparent insulating tube 9 is held. Subsequently, an electrode body 11 described below is inserted from the opening 12 on the side that is to be sealed first, into the portion 13*a*.

The electrode body 11 is an assembly in which the electrode 6, the metal foil 7 and the lead wire 8 are integrated. At an end of the lead wire 8 of the electrode body 11, a diamond-shaped spring 14 may be attached in such a manner as to press-contact partially an inner surface of the portion 13*a*. The electrode body 11 is held at a predetermined position in the portion 13*a* by an elastic stress of the spring 14.

After the electrode body 11 is inserted, while rotating the transparent insulating tube 9 about its longitudinal axis X (see FIG. 1) at a certain speed, an end of the portion 13*a* on the side of the portion 15, namely, a region A (see FIG. 1) is irradiated with a laser beam 17, for example from a laser beam oscillator 16, thereby heating and softening the region A so as to be sealed by shrinking. In other words, the region A is shrink-sealed. At the time of sealing, the transparent insulating tube 9 is filled with the inert gas such as argon gas.

In FIG. 1, numeral 18 denotes a light source portion for emitting the laser beam 17, numeral 19 denotes a reflecting mirror for reflecting the laser beam 17, and numeral 20 denotes a focusing lens for focusing the laser beam 17.

The laser beam 17 can be, for example, a carbon dioxide gas laser, an excimer laser, a YAG (yttrium aluminum garnet) laser or a semiconductor laser.

Figure 2:
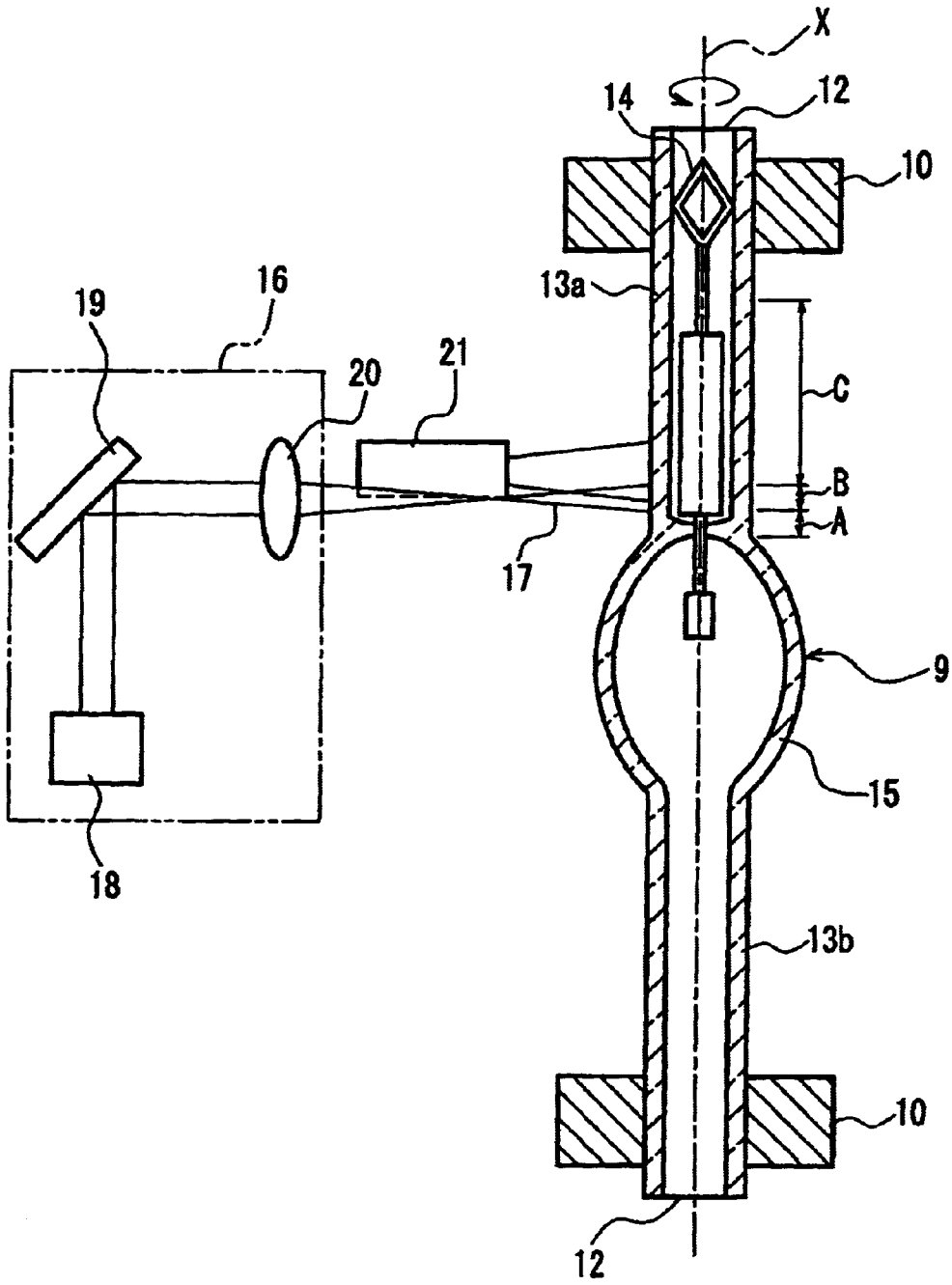
FIG. 2 is a sectional view for describing another process of the embodiment of the method for manufacturing the discharge tube according to the present invention.

Next, the laser beam oscillator 16 is moved upward from the position shown in FIG. 1 to that in FIG. 2 so that a region B adjacent to the region A of the transparent insulating tube 9 (see FIG. 2) is irradiated with the laser beam 17 so as to be heated and softened. At the same time as irradiating the region B with the laser beam 17 or before finishing shrink-sealing the region B with the laser beam 17, a gas burner 21 is turned on so that a part of the region B and a part of a region C adjacent to the region B (see FIG. 2) are subjected to a flame of the gas burner 21. In this manner, the region B is shrink-sealed by heating and softening with both the laser beam 17 and the gas burner 21.

When the finished discharge tube 1 is turned on, the high-pressure sealing gas that has been sealed in the discharge part 2 tends to rush in and cause cracks at a root portion of the electrode lead rod 5. Accordingly, the region A including the root portion of the electrode lead rod 5 particularly has to be processed to be highly air-tight and without distortion.

Figure 3:
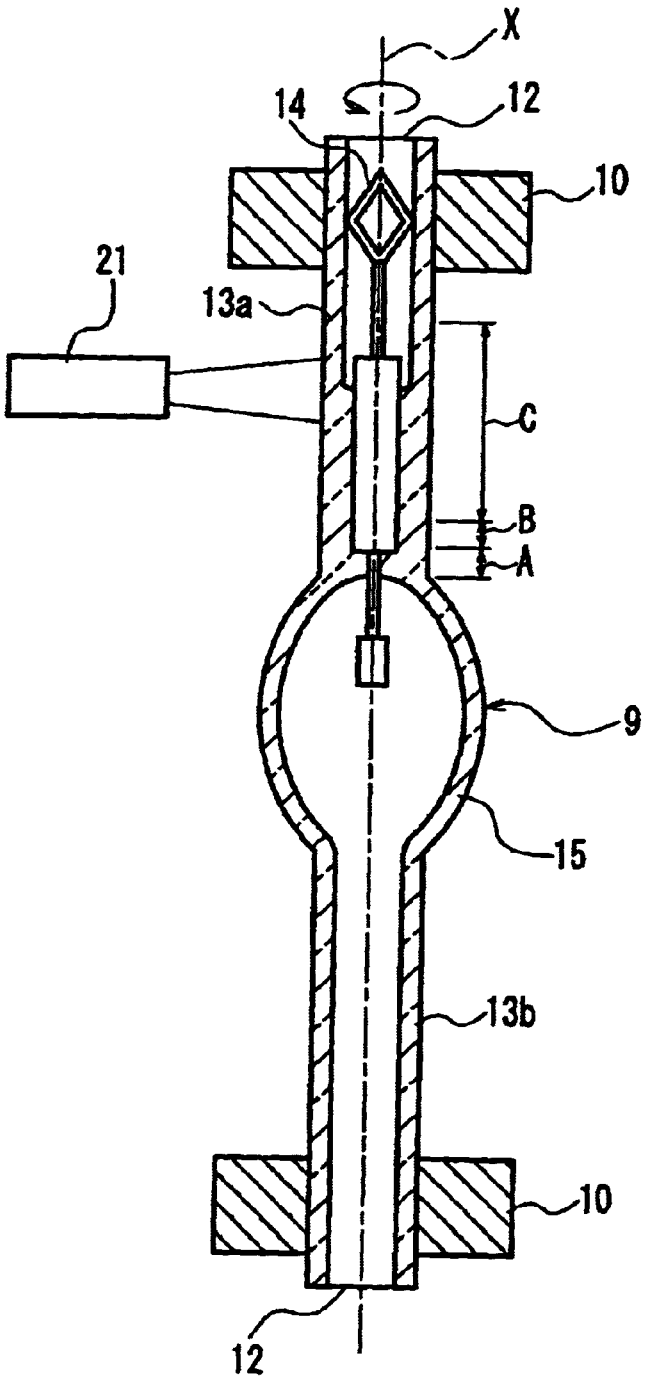
FIG. 3 is a sectional view for describing another process of the embodiment of the method for manufacturing the discharge tube according to the present invention.

After sealing the region B, the irradiation with the laser beam 17 is stopped, and the gas burner 21 continuously is moved upward as shown in FIG. 3. In other words, the region C is heated and softened sequentially from the side of the portion 15 toward the opposite side thereof, so as to be shrink-sealed. In this manner, the portion 13*a* is sealed entirely, so that one of the sealing parts 3 is formed.

Figure 4:
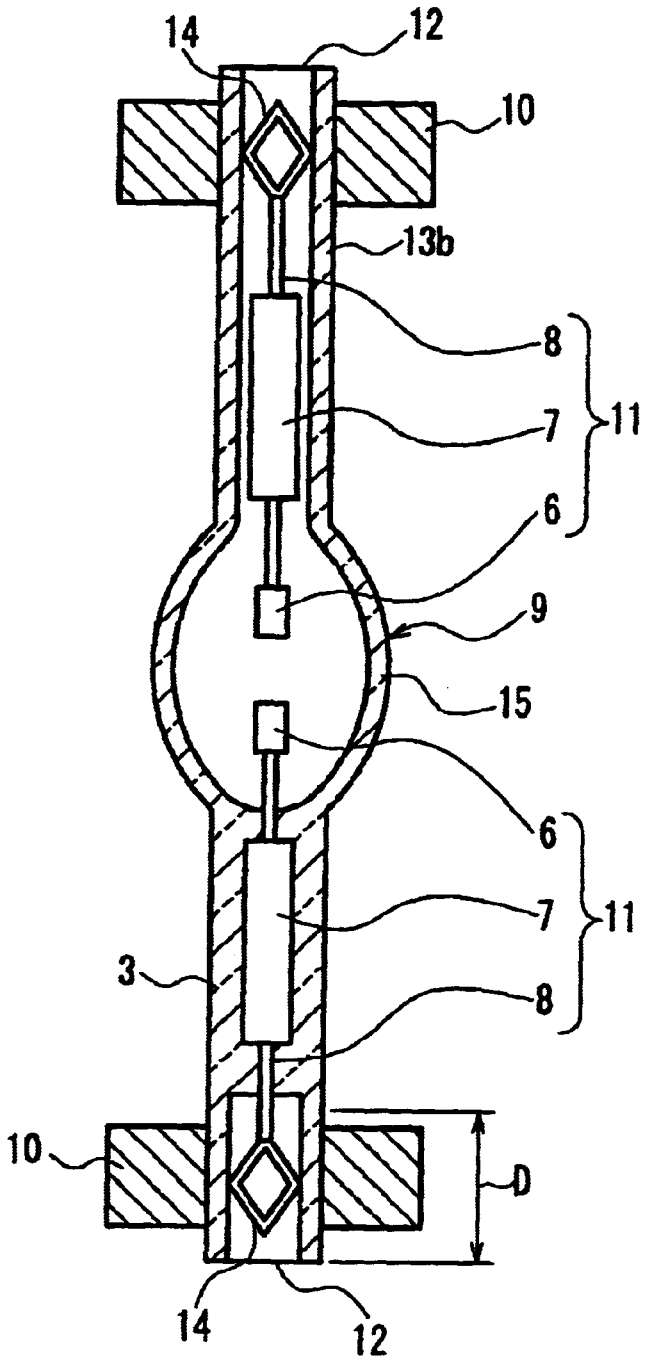
FIG. 4 is a sectional view for describing another process of the embodiment of the method for manufacturing the discharge tube according to the present invention.

Next, the transparent insulating tube 9 is turned upside down from the state shown in FIG. 3 to that in FIG. 4. With the transparent insulating tube 9 being kept upright so that the sealing part 3 faces downward, both ends thereof are held with the chucks 10.

Then, after enclosed materials such as mercury are introduced from the opening 12 of the portion 13*b*, the electrode body 11 is inserted from the same opening 12 and held at a predetermined position in the portion 13*b*.

Thereafter, the portion 13*b* is sealed in the same manner as the forming process of the sealing part 3 described above, thereby forming the other sealing part 3. When heating and softening the portion 13*b*, although not shown in the figure, it is preferable that the portion 15 is cooled by liquid nitrogen or the like so that the enclosed material inside the portion 15, for example mercury, will not evaporate.

The discharge part 2 is thus formed as each of the sealing parts 3 is formed.

After the discharge part 2 and the sealing parts 3 are formed, regions D at both ends of the transparent insulating tube 9 (one of them is shown in FIG. 4) are cut off, thus producing the discharge tube 1 as shown in FIG. 5.

Thereafter, the discharge tube 1 is provided with a lamp base (not shown in the figure) etc., thus producing the high-pressure mercury lamp.

The discharge tube 1 of the high-pressure mercury lamp with a rated power of 150 W (referred to as "a product of the present invention" in the following) was produced using the above-described method for manufacturing the discharge tube. When the total length of the region A and the region B was 2.2 mm, it took 82 seconds to seal one portion 13*a* (25 mm in length, 6 mm in outer diameter and 2 mm in thickness).

For comparison, using the same manufacturing method as in the above embodiment of the present invention except that the portion 13*a* entirely was sealed with the laser beam 17 alone, the discharge tube 1 of the high-pressure mercury lamp with a rated power of 150 W (referred to as "a comparative product" in the following) was produced. In this case, it took 400 seconds to seal one portion to be the sealing part 13*a*.

Incidentally, a carbon dioxide gas laser with an output power of 80 W was used as the laser beam 17 for each case.

When both the product of the present invention and the comparative product were operated at a rated power, no crack occurred in these discharge tubes 1 during a rated lifetime (2000 hours). This confirmed that both the products were highly resistant to pressure.

As described above, in the method for manufacturing the discharge tube of the present invention, the electrode bodies 11, each having the electrode 6, are inserted respectively into the portions 13*a* and 13*b* that are adjacent to the portion 15 of the transparent insulating tube 9 serving as a material for the discharge tube 1. Then, the portions 13*a* and 13*b* are sealed by heating and softening with a combination of the laser beam 17 and the gas burner 21, thus forming the sealing parts 3. At this time, it is preferable that the laser beam 17 and the gas burner 21 serving as heat sources for heating and softening the portions 13*a* and 13*b* are selected suitably according to each region in the portions 13*a* and 13*b*. In particular, by using the laser beam 17 for a portion requiring a high working accuracy in the portions 13*a* and 13*b*, for example, the ends of the portions 13*a* and 13*b* on the side of the portion 15, it is possible to achieve an air-tight sealing without any distortion, thereby obtaining a high-quality discharge tube 1 that is highly resistant to pressure. Also, by using the gas burner 21 having a larger heat capacity and a wider heating range than the laser beam 17 for portions other than the above-noted portion requiring a high working accuracy, it is possible to seal a wide range of regions in a short time, thus improving a production efficiency. In addition, by limiting the region to be heated and softened with the laser beam 17, it becomes possible to use the laser beam 17 having a lower output power. This allows miniaturization of the device and a cost reduction.

It is particularly preferable that the ends of the portions 13*a* and 13*b* on the side of the portion 15 are sealed by heating and softening with the laser beam 17 as described above. This makes it possible to form an inner surface of the discharge part 2 at the root portion of the electrode lead rod 5 into a smooth flat or curved surface as shown in FIG. 5. Thus, the pressure resistance in this portion can be improved.

Furthermore, immediately before or after the completion of sealing the ends of the portions 13*a* and 13*b* on the side of the portion 15 (for example, the regions A) by heating and softening with the laser beam 17, it is preferable to start heating and softening regions (simply referred to as "regions Z" in the following) that are adjacent to the heated and softened regions of the portions 13*a* and 13*b* (simply referred to as "regions Y" in the following) with the gas burner 21. Accordingly, when heating and softening the regions Z with the gas burner 21, it is possible to seal them in a short time because the regions Z are preheated by the heat applied to the regions Y adjacent to the regions Z. As a result, the period that the portion 15 is subjected to the wide flame of the gas burner 21 is reduced. Therefore, in the case where the sealing gas is filled in the portion 15, it is possible to prevent a damage of the portion 15 owing to a thermal expansion of the sealing gas.

Also, in the portions 13*a* and 13*b*, it is preferable that at least a part of the region to be heated and softened with the laser beam 17 and a part of the region to be heated and softened with the gas burner 21 overlap each other as in the region B. This can prevent the following problem. That is, the temperature of a boundary portion between the region to be heated and softened with the laser beam 17 and that to be heated and softened with the gas burner 21 becomes lower than the temperature of its surrounding portion, leading to an insufficient sealing, thus lowering air-tightness. Consequently, bubbles are mixed in the boundary portion. In addition, it is possible to prevent a decrease in the pressure resistance because of a distortion occurring in the formed sealing parts 3.

Moreover, it is preferable that each of the portions 13*a* and 13*b* is sealed sequentially from an end on the side of the portion 15 toward an end on the opposite side thereof. This makes it possible to lead out all the sealing gas inside the portions 13*a* and 13*b* to the outside of the transparent insulating tube 9 at the time of sealing. Thus, the following problem can be prevented. That is, if the sealing gas inside the portions 13*a* and 13*b* is compressed into the portion 15, a gas pressure therein rises excessively, thus damaging this portion.

However, in the case where the gas pressure in the portion 15 originally is low or where the portion 15 is sufficiently thick, for example, it is preferable that each of the portions 13*a* and 13*b* is sealed sequentially from an end on the opposite side of the portion 15 toward an end on the side thereof. This makes it possible to compress the sealing gas inside the portions 13*a* and 13*b* into the portion 15, so that the sealing gas can be used without wasting it. In this case, it is preferable that each of the portions 13*a* and 13*b* first is sealed sequentially from the end on the opposite side of the portion 15 toward the end on the side thereof with the gas burner and then the end on the side of the portion 15 finally is sealed with the laser beam.

The above-described embodiment has been directed to the case of using the transparent insulating tube 9 made of quartz glass. However, a similar effect also can be achieved in the case of using a transparent insulating tube made of borosilicate glass, transparent alumina or the like other than quartz glass.

Also, the above-described embodiment has been directed to the case of adopting a shrink-sealing as a method for sealing the softened portions 13*a* and 13*b*. However, a similar effect also can be achieved in the case of clamping and crushing softened portions 13*a* and 13*b*, namely, adopting a pinch-sealing other than the shrink-sealing.

Moreover, in the above-described embodiment, in the portions 13*a* and 13*b*, the regions to be heated and softened with the laser beam 17 are called the region A and the region B and the region to be heated and softened with the gas burner 21 is called the region C. However, the regions to be heated and softened with the laser beam 17 and with the gas burner 21 can be selected suitably. For example, the region B and a part of the region C may be heated and softened with the gas burner 21 and the laser beam 17, respectively.

Furthermore, the above-described embodiment has been directed to an example of the method for manufacturing the discharge tube of the high-pressure mercury lamp. However, the present invention also can be applied to a method for manufacturing a discharge tube, for example, in a metal halide lamp or a one-side sealed discharge lamp.

Second Embodiment

Figure 6:
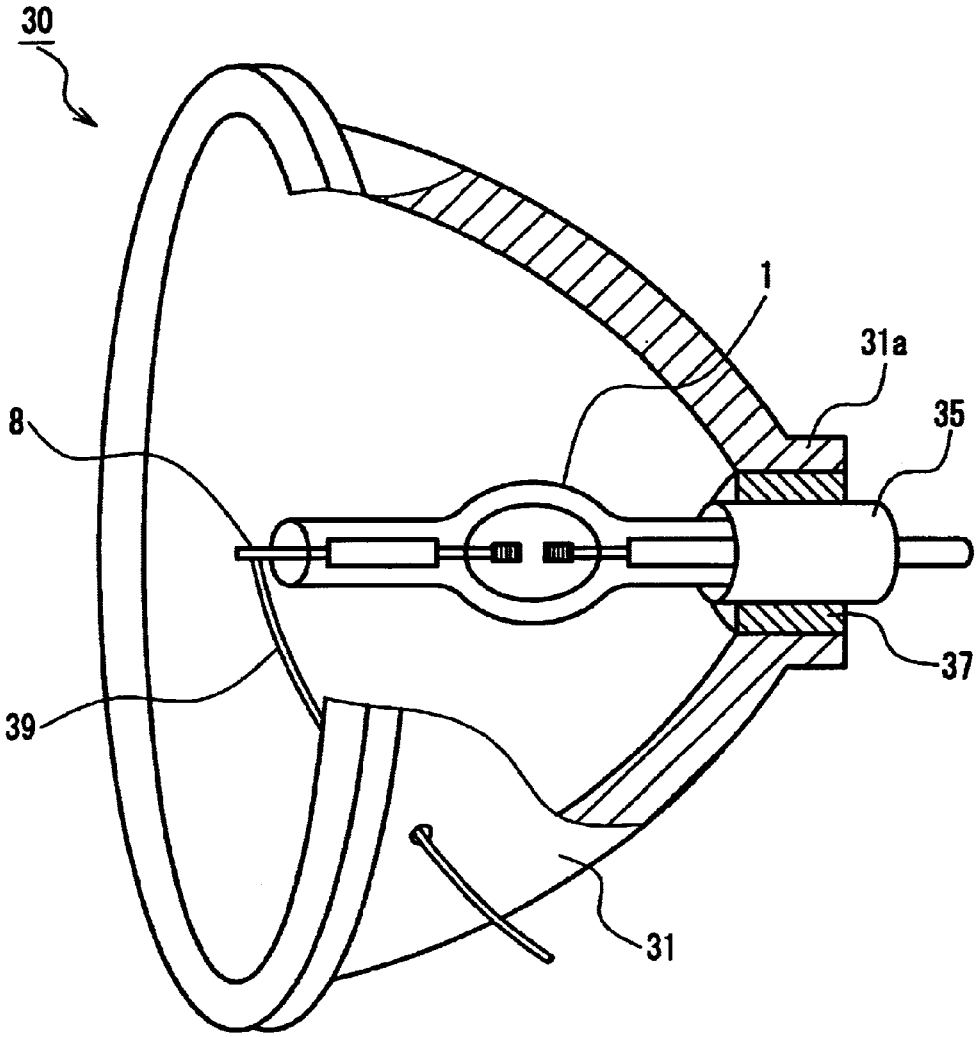
FIG. 6 is a partially broken perspective view showing one embodiment of a discharge lamp provided with a reflector according to the present invention.

FIG. 6 is a partially broken perspective view showing one example of a discharge lamp provided with a reflector, using a discharge tube obtained by the manufacturing method of the present invention described in the first embodiment.

As shown in the figure, a discharge lamp 30 provided with a reflector according to the present embodiment includes a reflector 31 and the discharge tube 1 produced by the manufacturing method of the first embodiment. The discharge tube 1 is located inside the reflector 31 and integrated therewith such that an arc axis formed between the electrode coils 4 (see FIG. 5) is on an optical axis of the reflector 31. The reflector 31 may be made of ceramic, has a funnel shape and has a reflecting surface that may be formed of a titanium oxide-silicon oxide evaporated film on its inner surface. A tubular part 31*a* is provided at an opposing end of an opening of the reflector 31.

One of the sealing parts 3 of the discharge tube 1 (see FIG. 5) is provided with a lamp base 35. This lamp base 35 is inserted in the tubular part 31*a* of the reflector 31, and the two are firmly fixed, for example with an insulating cement 37, thereby integrating the reflector 31 and the discharge tube 1.

One of the lead wires 8 of the discharge tube 1 (see FIG. 5) is electrically connected to the lamp base 35. The other lead wire 8 is connected to one end of a power supply line 39. The other end of the power supply line 39 passes through the reflector 31 and is led out to the side opposite to the reflecting surface of the reflector 31.

The above-described discharge lamp 30 provided with the reflector is used as, for example, a light source of a liquid crystal projector.

Third Embodiment

Figure 7:
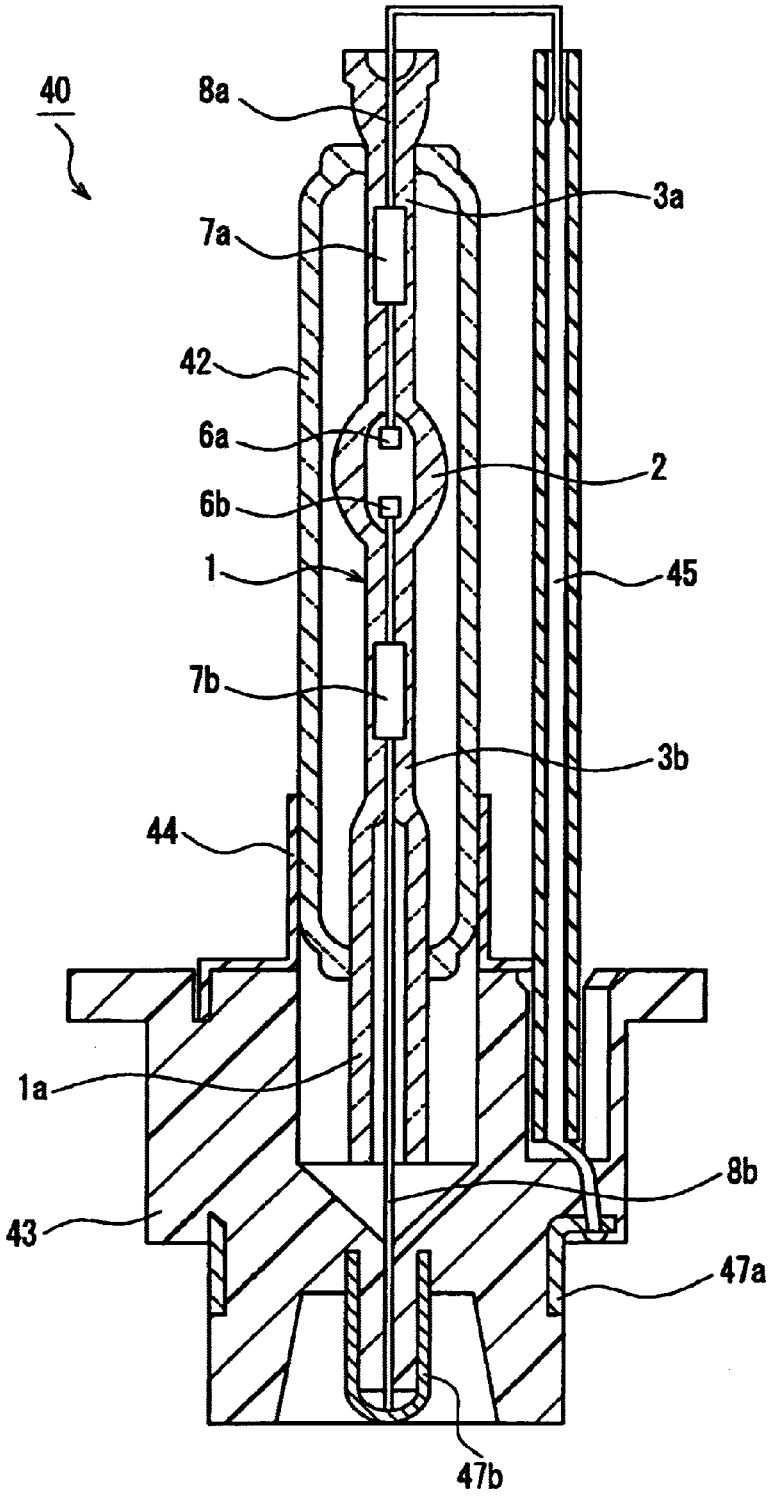
FIG. 7 is a sectional view showing one embodiment of a discharge lamp for an automotive headlight according to the present invention.

FIG. 7 is a sectional view showing one example of a discharge lamp for an automotive headlight, using a discharge tube obtained by the manufacturing method of the present invention described in the first embodiment.

As shown in the figure, a 35 W discharge lamp 40 for an automotive headlight according to the present embodiment includes the discharge tube 1 produced according to the manufacturing method of the first embodiment, an outer tube 42 and a lamp base 43.

The discharge tube 1 has the discharge part 2, sealing parts 3*a* and 3*b* at both ends of the discharge part 2 and a cylindrical part (an unsealed portion) la that is provided in connection with an end of the sealing part 3*b*.

The outer tube 42 surrounds the discharge tube 1, and both ends of the outer tube 42 are fused with outer peripheries of both ends of the discharge tube 1.

The lamp base 43 may be made of resin such as polyetherimide. The end of the discharge tube 1 on the side of the cylindrical part 1*a* is inserted in a hole at the center of the lamp base 43, and a holder 44 attached to the lamp base 43 holds one end of the outer tube 42, whereby the discharge tube 1 is held by the lamp base 43.

Inside the discharge part 2 of the discharge tube 1, a pair of electrodes 6*a* and 6*b* are provided, and $ScI_3$ and NaI as metal halides, xenon as a starting gas and mercury are sealed. One electrode 6*a* is connected to a lead wire 8*a* via a metal foil 7*a*, and the lead wire 8*a* is connected to one end of a power supply line 45. The power supply line 45 is arranged outside the outer tube 42 so as to be parallel therewith, and the other end of the power supply line 45 is connected to a power supply terminal 47*a* that is provided in the lamp base 43. The other electrode 6*b* is connected to a lead wire 8*b* via a metal foil 7*b*, and the lead wire 8*b* is connected to a power supply terminal 47*b* that is provided in the lamp base 43.

The discharge lamps of the second and third embodiments include a discharge tube obtained by the manufacturing method described in the first embodiment. Therefore, their discharge tubes are highly resistant to pressure, and they are high in quality and production efficiency and can be produced at low cost.

The configuration of the discharge lamp including the discharge tube obtained by the manufacturing method of the present invention is not limited to the examples illustrated in the second and third embodiments. The discharge tube of the present invention can be used widely as a discharge tube for a known discharge lamp.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A method for manufacturing a discharge tube, the discharge tube comprising a discharge part, a sealing part formed at an end of the discharge part, and an electrode provided in the discharge part, the method comprising:

inserting an electrode body having the electrode into a portion to be the sealing part that is adjacent to a portion to be the discharge part of a transparent insulating tube serving as a material for the discharge tube; and sealing the portion to be the sealing part by heating and softening with a combination of a laser beam and a gas burner, thus forming the sealing part, wherein immediately before or after completion of sealing an end of the portion to be the sealing part on a side of the portion to be the discharge part by heating and softening with the laser beam, a region that is adjacent to the heated and softened region of the portion to be the sealing part starts being heated and softened with the gas burner.

2. The method for manufacturing a discharge tube according to claim 1, wherein the end of the portion to be the sealing part on the side of the portion to be the discharge part is sealed by heating and softening with the laser beam, and a portion other than the end of the portion to be the sealing part on the side of the portion to be the discharge part is sealed by heating and softening with the gas burner.

3. The method for manufacturing a discharge tube according to claim 1, wherein the portion to be the sealing part is sealed sequentially from an end on a side of the portion to be the discharge part toward an end on an opposite side of the portion to be the discharge part.

4. The method for manufacturing a discharge tube according to claim 1, wherein the portion to be the sealing part is sealed sequentially from an end on an opposite side of the portion to be the discharge part toward an end on a side of the portion to be the discharge part.

5. The method for manufacturing a discharge tube according to claim 1, wherein at least a part of a region to be heated and softened with the laser beam and a part of a region to be heated and softened with the gas burner overlap each other in the portion to be the sealing part.

6. A discharge lamp comprising a discharge tube obtained by the method according to claim 1.

7. A discharge lamp comprising:

a discharge tube obtained by the method according to claim 1, and a reflector.

8. A discharge lamp comprising:

a discharge tube obtained by the method according to claim 1, an outer tube surrounding the discharge tube, and a lamp base provided at an end of the outer tube.

9. The method for manufacturing a discharge tube comprising a discharge part, a sealing part formed at an end of the discharge part, and an electrode provided in the discharge part, the method comprising:

inserting an electrode body having the electrode into a portion to be the sealing part that is adjacent to a portion to be the discharge part of a transparent insulating tube serving as a material for the discharge tube; and sealing the portion to be the sealing part by heating and softening with a combination of a laser beam and a gas burner, thus forming the sealing part, wherein at least a part of a region to be heated and softened with the laser beam and a part of a region to be heated and softened with the gas burner overlap each other in the portion to be the sealing part.

10. A discharge lamp comprising a discharge tube obtained by the method according to claim 9.

11. A discharge lamp comprising:

a discharge tube obtained by the method according to claim 9, and a reflector.

12. A discharge lamp comprising:

a discharge tube obtained by the method according to claim 9, an outer tube surrounding the discharge tube, and a lamp base provided at an end of the outer tube.

* * * * *